US006801733B2

(12) United States Patent
Daniels et al.

(10) Patent No.: US 6,801,733 B2
(45) Date of Patent: Oct. 5, 2004

(54) PRINTER CARTRIDGE AND METHOD OF MAKING OR REFURBISHING

(75) Inventors: Matthew P. Daniels, Pittsboro, NC (US); Lawrence D. Lewis, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 79 days.

(21) Appl. No.: 10/248,451

(22) Filed: Jan. 21, 2003

(65) Prior Publication Data

US 2004/0141768 A1 Jul. 22, 2004

(51) Int. Cl.[7] ..... G03G 15/00

(52) U.S. Cl. ..... 399/109; 29/890.1; 29/854; 29/402.01; 29/402.02; 29/402.09; 29/402.14; 29/402.16

(58) Field of Search ..... 399/106, 107, 399/109, 111, 113, 13, 61; 439/66, 244, 700, 824; 29/402.01, 402.02, 402.09, 402.14, 402.16, 402.08, 890.1, 831, 894, 854

(56) References Cited

U.S. PATENT DOCUMENTS

| | | | | |
|---|---|---|---|---|
| 4,750,094 A | * | 6/1988 | Krasik | |
| 5,201,854 A | | 4/1993 | Ahl et al. | 439/247 |
| 5,296,901 A | | 3/1994 | Davies | 399/90 |
| 5,365,315 A | | 11/1994 | Baker et al. | 399/111 |
| 5,500,714 A | | 3/1996 | Yashiro et al. | 399/111 |
| 5,581,325 A | | 12/1996 | Tsuda et al. | 399/116 |
| 5,768,658 A | | 6/1998 | Watanabe et al. | 399/111 |
| 5,768,660 A | | 6/1998 | Kurihara et al. | 399/111 |
| 5,828,929 A | | 10/1998 | Watanabe et al. | 399/111 |
| 5,870,655 A | | 2/1999 | Nishiuwatoko et al. | 399/111 |
| 5,873,012 A | | 2/1999 | Miyabe et al. | 399/90 |
| 5,923,350 A | | 7/1999 | Ohnishi et al. | 347/50 |
| 5,926,666 A | | 7/1999 | Miura et al. | 399/25 |
| 5,950,047 A | | 9/1999 | Miyabe et al. | 399/111 |
| 6,033,233 A | * | 3/2000 | Haseyama et al. | 439/66 |
| 6,074,042 A | | 6/2000 | Gasvoda et al. | 347/50 |
| 6,095,823 A | * | 8/2000 | Banks | 439/66 |
| 6,097,908 A | | 8/2000 | Uchiyama et al. | 399/111 |
| 6,128,452 A | | 10/2000 | Miyabe et al. | 399/90 |
| 6,151,465 A | | 11/2000 | Toba et al. | 399/90 |
| 6,154,623 A | | 11/2000 | Suzuki et al. | 399/111 |
| 6,167,219 A | | 12/2000 | Miyamoto et al. | 399/90 |
| 6,185,390 B1 | | 2/2001 | Higeta et al. | 399/90 |
| 6,201,935 B1 | | 3/2001 | Terada et al. | 399/13 |
| 6,215,969 B1 | | 4/2001 | Nomura et al. | 399/111 |
| 6,289,189 B1 | | 9/2001 | Numagami et al. | 399/111 |
| 6,308,028 B1 | | 10/2001 | Yashiro et al. | 399/111 |
| 6,351,620 B1 | | 2/2002 | Miyabe et al. | 399/111 |

(List continued on next page.)

FOREIGN PATENT DOCUMENTS

| | | |
|---|---|---|
| JP | 63095970 | 10/1989 |

*Primary Examiner*—Arthur T. Grimley
*Assistant Examiner*—Ryan Gleitz
(74) *Attorney, Agent, or Firm*—Moore & Van Allen, PLLC; Charles L. Moore, Jr.

(57) ABSTRACT

A printer cartridge and method of making or refurbishing a printer cartridge are disclosed. The printer cartridge may include a first cartridge subassembly attached to a second cartridge subassembly. The first cartridge subassembly may include a first conductive terminal and the second cartridge subassembly may include a second conductive terminal that is normally in electrical contact with the first conductive terminal when the first and second subassemblies are assembled. A compressible toner seal may be disposed between the first and second cartridge subassemblies. A compressible, electrically conductive extension may be attached to the first conductive terminal to compensate for variations in thickness of the compressible toner seal or relative movement of the first cartridge subassembly relative to the second cartridge subassembly when the first and second subassemblies are attached to one another to form the printer cartridge.

17 Claims, 3 Drawing Sheets

U.S. PATENT DOCUMENTS

| | | | | |
|---|---|---|---|---|
| 6,400,914 | B1 | 6/2002 | Noda et al. | 399/90 |
| 6,431,684 | B1 | 8/2002 | Olsen | 347/50 |
| 6,442,359 | B1 | 8/2002 | Numagami et al. | 399/111 |
| 6,463,233 | B2 | 10/2002 | Kojima et al. | 399/111 |
| 2001/0017990 | A1 * | 8/2001 | Oguma et al. | 399/111 |
| 2001/0041079 | A1 | 11/2001 | Michlin et al. | 399/90 |
| 2002/0064390 | A1 | 5/2002 | Oguma et al. | 399/90 |
| 2002/0085854 | A1 | 7/2002 | Numagami et al. | 399/90 |
| 2002/0097298 | A1 | 7/2002 | Yun | 347/50 |

* cited by examiner

PRINTER CARTRIDGE AND METHOD OF MAKING OR REFURBISHING

BACKGROUND OF INVENTION

FIELD OF THE INVENTION

The present invention relates to computer printers and similar devices and more particularly to a printer cartridge, refurbished or remade printer cartridge and a method of making or refurbishing printer cartridges or similar devices.

Printer cartridges, such as laser printer cartridges or similar devices may be made or refurbished by filling the cartridges with toner, ink or the like and replacing any damaged or worn parts. To refurbish and refill a cartridge, the cartridge may generally need to be disassembled and reassembled. Component parts, such as electrical contacts, terminals or the like, can be damaged or misaligned during the manufacturing or refurbishing process. Electrical contacts on different components of the cartridge may therefore not make proper contact with one another when the cartridge is assembled or reassembled and the cartridge may malfunction or not be able to provide some features, such as generating a message when toner level is low or the like. Some of the electrical contacts may not make proper contact with one another because of variations in tolerances between different components. For example, a compressible seal around a toner discharge opening in a toner hopper subassembly of a printer cartridge may cause variations in the dimension between the toner hopper subassembly and a developer roller subassembly when attached to one another. The compressible seal may also compress or move to permit relative movement between the toner hopper subassembly and the developer roller subassembly. The variations in dimensions or movement of the subassemblies may prevent respective contacts on the toner hopper subassembly and the developer roller subassembly from making proper contact or to break contact after assembly and the cartridge may malfunction or not provide certain features.

Additionally, some electrical contacts may be internal to the cartridge on some types of cartridges when assembled. This may prevent access to the contacts or terminals for testing to confirm whether the contacts or terminals are properly making contact after assembling the cartridge.

Accordingly, there is a need to provide a method to make or refurbish a printer cartridge that compensates for variations in tolerances in the manufacturing or refurbishing process or movement of the subassemblies relative to one another. There is also a need to provide a printer cartridge or refurbished printer cartridge that compensates for variations in tolerance between different components or movement of the components relative to one another. There is an additional need to provide a method to make or refurbish a printer cartridge that permits access to any internal contacts or terminals for testing of the electrical contact or connection. There is a further need to provide a printer cartridge or refurbished printer cartridge that includes access to any internal contacts or terminals for testing.

SUMMARY OF INVENTION

In accordance with an embodiment of the present invention, a method of making or refurbishing a printer cartridge may include attaching a compressible, electrically conductive extension to a first conductive terminal on a first cartridge subassembly. The first cartridge subassembly may be assembled in operative position with a second cartridge subassembly. The compressible, electrically conductive extension may electrically couple the first conductive terminal to a second conductive terminal on the second cartridge subassembly when the first and second cartridge subassemblies are assembled.

In accordance with another embodiment of the present invention, a method of making or refurbishing a printer cartridge may include attaching an electrically conductive coil spring to a first conductive terminal on a first cartridge subassembly. The first cartridge subassembly may then be assembled in operative position with a second cartridge subassembly. The electrically conductive coil spring may compensate for variations in thickness of a compressible toner seal, or compensate for movement of the first cartridge subassembly relative to the second cartridge subassembly, to electrically couple the first conductive terminal to a second conductive terminal on the second cartridge when the first and second cartridge subassemblies are assembled and compress the toner seal.

In accordance with a further embodiment of the present invention, a printer cartridge may include a first cartridge subassembly and a second cartridge subassembly attached to the first cartridge subassembly. The first cartridge subassembly may include a first conductive terminal and the second cartridge subassembly may include a second conductive terminal that is normally in electrical contact with the first conductive terminal when the first and second subassemblies are attached to one another. A compressible, electrically conductive extension may be attached to the first conductive terminal to compensate for variations in thickness of a compressible toner seal or to compensate for movement of the first cartridge subassembly relative to the second cartridge subassembly when the first and second subassemblies are attached to one another to form the printer cartridge.

DETAILED DESCRIPTION

The following detailed description of preferred embodiments refers to the accompanying drawings which illustrate specific embodiments of the invention. Other embodiments having different structures and operations do not depart from the scope of the present invention.

Figure 1:
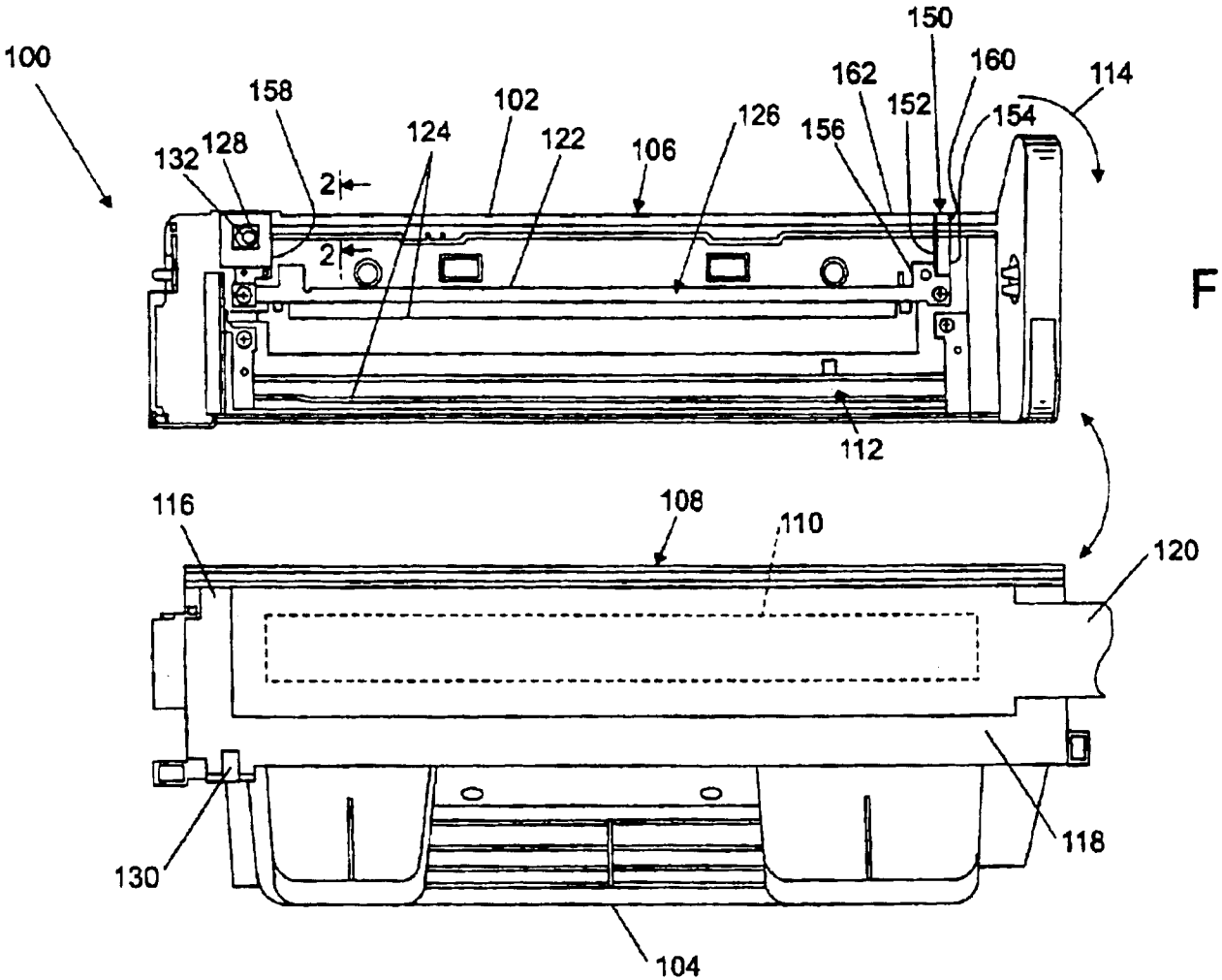
FIG. 1 is an exploded view of an example of an unassembled printer cartridge in accordance with an embodiment of the present invention.

FIG. 1 is an exploded view of an example of an unassembled printer cartridge 100 in accordance with an embodiment of the present invention. The printer cartridge 100 may be a laser printer toner cartridge, such as an HP 4100 laser printer toner cartridge as manufactured by Hewlett-Packard or the like. The printer cartridge 100 may include a first printer cartridge subassembly or developer roller subassembly 102 and a second printer cartridge subassembly or toner hopper subassembly 104. An operative face 106 of the developer roller subassembly 102 is shown in FIG. 1 and a hopper opening face 108 of the toner hopper subassembly 104 is also shown in FIG. 1. The toner hopper subassembly 104 may contain toner (not shown in FIG. 1) and may include a discharge opening 110 (illustrated by a broken line in FIG. 1) through which toner may pass to the developer roller subassembly 102 or the first cartridge subassembly. The developer roller subassembly 102 may include a corresponding opening 112 that may substantially mate with the toner hopper discharge opening 110 when the developer roller subassembly 102 is assembled in operative position with the toner hopper subassembly 104. In assembling the printer cartridge 100, the operative face 106 of the developer roller subassembly 102 may be matingly placed in operative position with the opening face 108 in the toner hopper subassembly 104, such that the discharge opening 110 aligns with the corresponding opening 112. The developer roller subassembly 102 may be rotated in a direction illustrated by arrow 114 in FIG. 1 to a position where the operative face 106 of the developer roller subassembly 102 faces the opening face 108 of the toner hopper subassembly 104. The faces 106 and 108 may then be placed in abutment with one another.

The discharge opening 110 may be substantially completely surrounded by a compressible toner seal 116 that may be attached to a toner hopper sealing surface 118 by an adhesive or the like. The compressible toner seal 116 may be a rubberized foam type material or similar material to provide a substantially hermetic seal. The seal 116 provides a closed seal around the discharge opening 110 and corresponding opening 112 in the developer roller subassembly 102 to prevent toner from migrating or leaking from the toner hopper subassembly 104. A removable packaging seal 120 may also be attached by an adhesive or the like to the compressible seal 116 and over the toner discharge opening 110. The removable packaging seal 120 retains the toner in the toner hopper subassembly 104 and may be stripped away or removed by an end user when installing the cartridge 100 in a printer (not shown in FIG. 1).

A first sensing bar 122 and a second sensing bar or bars 124 may be attached to the developer roller subassembly 102. The first sensing bar 122 and the second sensing bar 124 may extend substantially parallel to one another and substantially completely across the corresponding toner discharge opening 112 in the developer roller subassembly 102. The first sensing bar 122 and the second sensing bar 124 may be formed from a conductive material such as copper, aluminum, an alloy or similar electrically conductive material. The first and second sensing bars 122 and 124 may form a portion of a capacitor type device 126 that may be used to sense a toner level or other operating parameters of the printer cartridge 100. A magnetic developer roller 127 (FIG. 4) may also form part of the capacitor type device 126 or another capacitor device to sense toner level or other operating parameters of the printer cartridge 100. A printer (not shown in FIG. 1) in which the printer cartridge 100 is installed may sense a change in capacitance signal across the capacitor type device 126 and may generate an electrical signal corresponding to a level of toner in the toner hopper subassembly 104. A message indicating the toner level may be displayed on a display of the printer or on a user's computer monitor (not shown in FIG. 1) in response to the electrical signal from the capacitor device 126.

The first sensing bar 122 may be connected to a first conductive contact or terminal 128 on the developer roller subassembly 102. At least one second contact or terminal 130 may be attached to the toner hopper subassembly 104. The first and second contacts or terminals 128 and 130 may be made from copper, aluminum or the like. The first conductive terminal or terminals 128 normally electrically couple to or contact the second conductive terminal 130 when the developer roller subassembly 102 is assembled in an operative position with the toner hopper subassembly 104 to form the printer cartridge 100.

The compressible toner seal 116 may be compressed between the developer roller subassembly 102 and the toner hopper subassembly 104 to seal in the toner when the subassemblies 102 and 104 are attached to one another to form the printer cartridge 100. Variations in the thickness of the compressible seal 116 may prevent the first and second terminals or contacts 128 and 130 from making proper electrical contact with one another when the printer cartridge 100 is made or refurbished. Additionally, the subassemblies 102 and 104 may be attached or snapped together with resilient latches, tabs or the like (not shown in the drawings). The subassemblies 102 and 104 may then be able to move slightly relative to one another in various directions, such as in a rocking motion, laterally or similar movement relative to one another. If the first and second terminals 128 and 130 do not contact one another or if the connection is faulty, the capacitor device 126 may not function properly or at all to generate a signal corresponding to the toner level or other operating parameter. A compressible, electrically conductive extension 132 may be attached to the first conductive contact or terminal 128 on the developer roller subassembly 102. The compressible, electrically conductive extension 132 may be an electrically conductive coil spring or similar structure. The conductive extension or coil spring 132 may then compensate for any variations in compression of the seal 116 to make an electrical connection between the terminals 128 and 130. The coil spring 132 may also flex to compensate for any relative motion of the subassemblies 102 and 104, as described above, to maintain a continuous electrical connection between the terminals 128 and 130.

Figure 2:
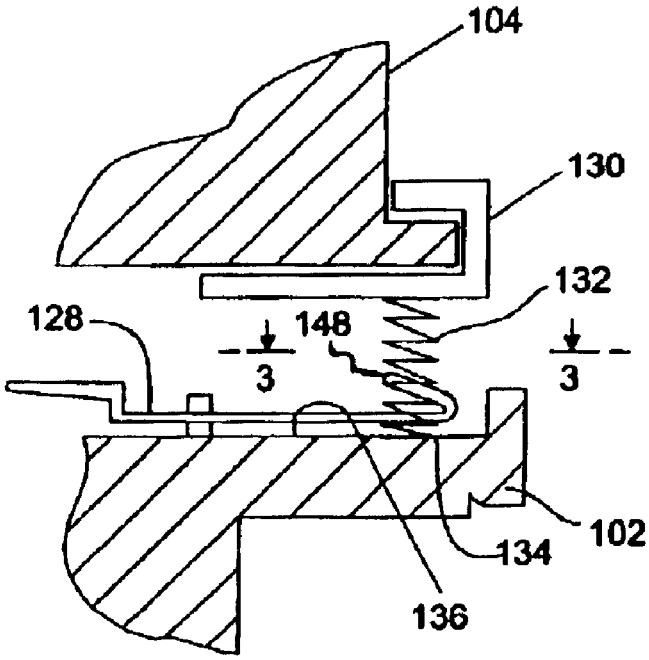
FIG. 2 is a partial cross-sectional view of the printer cartridge of FIG. 1 taken along lines 2—2 showing a compressible, electrically conductive extension in accordance with an embodiment of the present invention.

In one embodiment of the present invention as shown in FIG. 2, the conductive coil spring 132 may be attached to the first conductive terminal 128 by wedging at least an end coil 134 of the coil spring 132 between the first conductive terminal 128 and a housing 136 of the developer roller subassembly 102. Accordingly, interference between the end coil 134, the housing 136 and the first terminal 128 will retain the conductive coil spring 132 in place during manufacturing or refurbishing of the printer cartridge 100. The coil spring 134 may also be soldered or an adhesive may be applied to provide a more robust attachment of the coil spring 134 to the first terminal 128. Accordingly, the coil spring 132 will make an electrical connection between the first conductive terminal 128 and the second conductive terminal 130 when the developer roller subassembly 102 is assembled with the toner hopper subassembly 104 as shown in FIG. 2. The coil spring 132 may compress from an original length to compensate for compression of the seal 116 and variations in the thickness of the compressed seal 116 when the printer cartridge 100 is formed to electrically connect the first and second terminals 128 and 130. The coil spring 132 may also flex in different directions to further compensate for any relative movement of the terminals 128 and 130 relative to one another after assembly, such as, for example when stresses may be placed on the subassemblies 102 and 104 when inserted into a printer. Such stresses may cause the subassemblies 102 and 104 to move relative to one another.

Figure 3:
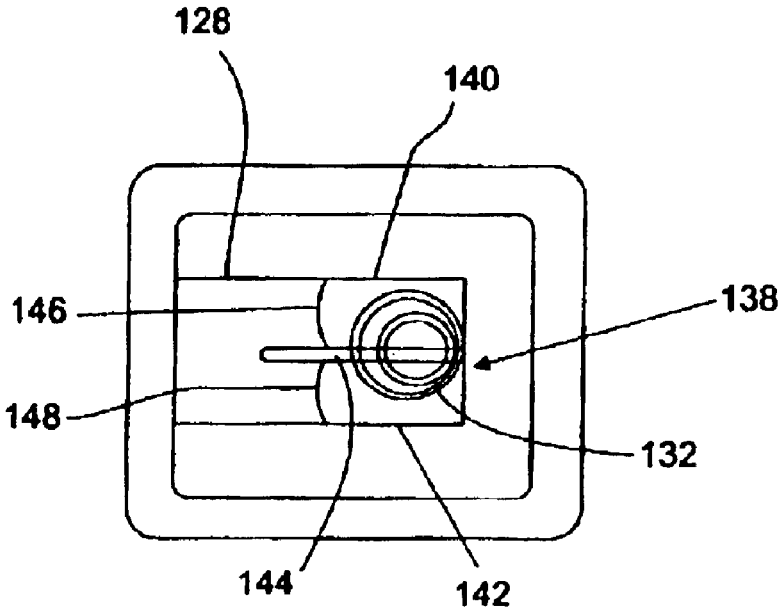
FIG. 3 is a partial cross-sectional view of the compressible, electrically conductive extension of FIG. 2 taken along lines 3—3 in accordance with an embodiment of the present invention.

In an embodiment of the present invention shown in FIG. 3, the first terminal 128 may include a bifurcated or forked portion 138. The bifurcated portion 138 may be divided into a first terminal segment or bifurcation 140 and a second terminal segment or bifurcation 142. The end coil 134 of the conductive coil spring 132 may be wedged between the first contact 128 and the housing 136 of the developer roller subassembly 102 similar to that shown in FIG. 2. A coil of the spring 132 may extend through an opening 144 between the bifurcations 140 and 142 to retain the spring 132 in position. The bifurcations 140 and 142 may also each include a biased or resilient end contact portion 146 and 148, respectively, that may be each be folded or bent back over the first terminal 128 as best shown in FIG. 2 to form a substantially hook shape. The resilient end contact portions 146 and 148 may extend through coils of the spring 132 to effectively hook the coils to further retain the spring 132 in position in contact with the first terminal 128.

The end contact portions 146 and 148 may be intended to make electrical contact with the second terminal 130 in some printer cartridges when originally manufactured. However, under some circumstances, such as refurbishing a printer cartridge, variations in the thickness of the compressible seal 116, relative motion of the subassemblies 102 and 104, as described above, or other variations may prevent the end contact portions 146 and 148 from making good electrical contact with the second terminal 130. A compressible, electrically conductive extension, such as the coil spring 132 or the like, may be attached to the first terminal 128 using the existing contact portions 146 and 148 to insure electrical contact with the second terminal 130. Accordingly, the present invention may utilize the existing electrical contact structure to retain the spring 132 in position during manufacturing or refurbishing, requiring minimal process operations.

In another embodiment of the present invention, the end contact portions 146 and 148 may not be present or may be damaged and unusable. The coil spring 132 may then be attached to the first conductive terminal 128 by soldering, applying an adhesive that may be conductive or by a similar arrangement.

Figure 4:
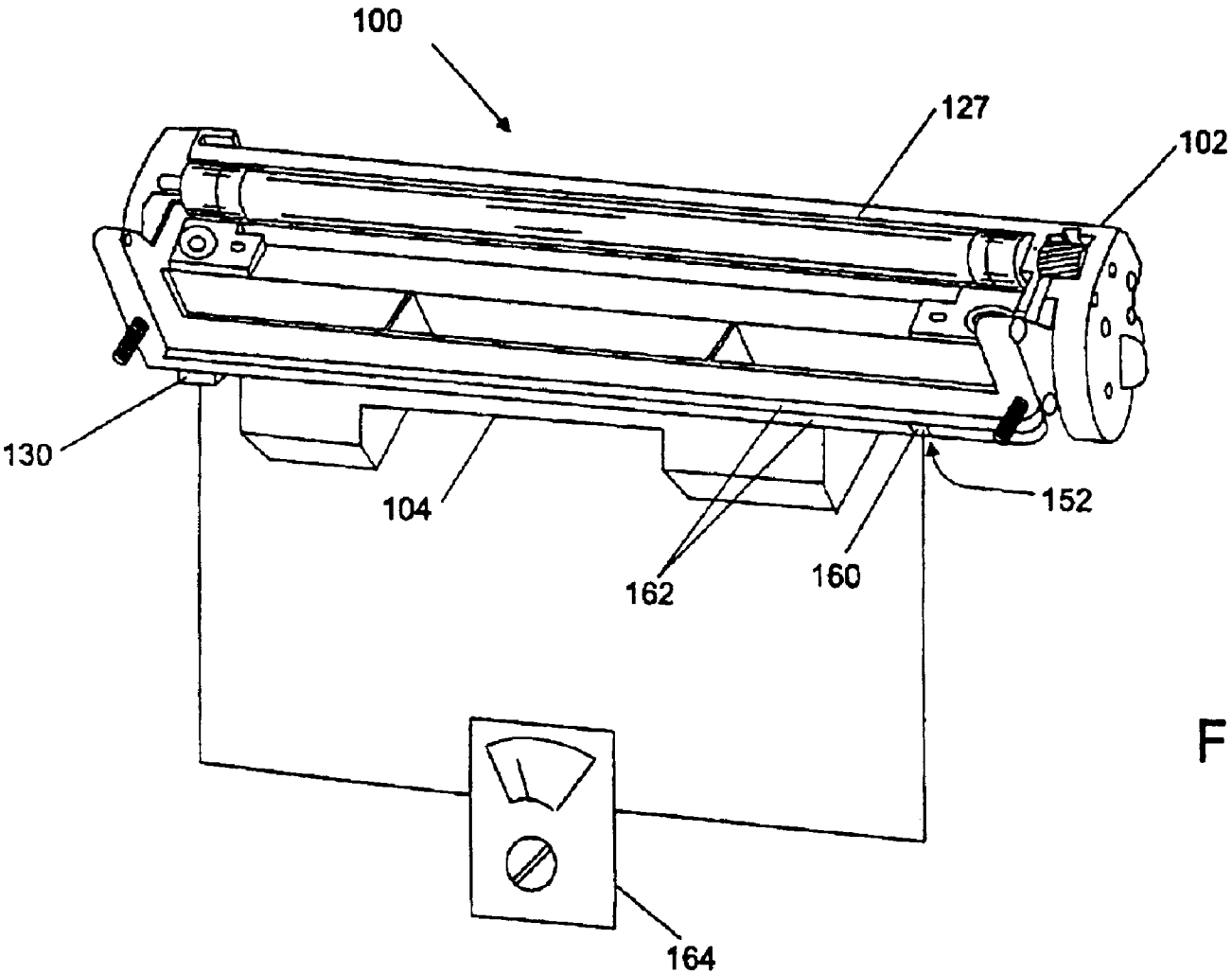
FIG. 4 is a perspective view of an example of an assembled printer cartridge in accordance with an embodiment of the present invention

Referring back to FIG. 1, the first conductive terminal 128 may not be accessible after the developer roller subassembly 102 is assembled with the toner hopper assembly 104. Because the first terminal 128 may be inaccessible, testing the continuity or electrical contact between the first and second terminals 128 and 130 directly may not be possible. In an embodiment of the present invention, an external electrically conductive access 150 may be provided or formed to provide access to the first terminal 128 for testing and other purposes after assembling the printer cartridge 100. The external access 150 may include a conductive strip 152 or the like. A first portion 154 of the conductive strip 152 may be attached to the first sensing bar 122 proximate to an end 156 of the opening 112 opposite to an end 158 where the first terminal 128 may be attached to the developer roller subassembly 102. The conductive strip 152 may be a dead-soft aluminum strip with a thickness of about 2 mils. The strip 152 may be attached to the first sensing bar 122 and the roller developer subassembly 102 by a conductive acrylic adhesive or similar means. The conductive strip 152 or tape may be a Compac® #812 aluminum foil tape with a conductive adhesive or the like. The strip 152 may also be made from other conductive materials such as copper, an alloy or the like. The total thickness of the strip 152 with the adhesive may be about 4 mils or less. The strip 152 may be placed clear of the openings 112 and 110 so as to not interfere with the discharge of toner when the cartridge 100 is in use. The dimensions of the conductive strip 152 may vary as a function of the structure and dimensions of the particular printer cartridge 100. The conductive strip 152 may be sized to not interfere with the normal operation of the printer cartridge 100 when in use. A second portion 160 of the conductive strip 152 may extend at least to an outer edge 162 of the developer roller subassembly 102 and may be folded over the outer edge 162 as best shown in FIG. 4. FIG. 4 shows the assembled printer cartridge 100. The second portion 160 of the conductive strip 152 is exposed and accessible for testing the continuity or connection between the first terminal 128 (FIG. 1) and the second terminal 130 that may also be exposed and accessible after the printer cartridge 100 is assembled. A multimeter 164 may be connected between the conductive strip 152 and the exposed portion of the second terminal 130 to measure the continuity. Accordingly, the conductive strip 152 provides an external access to the first contact or terminal 128 that may be inaccessible after the printer cartridge 100 is assembled. Although the present invention has been described with respect to using a conductive strip 152, any device or arrangement that may provide access to an inaccessible contact or terminal after the cartridge 100 is assembled may be used.

Although specific embodiments have been illustrated and described herein, those of ordinary skill in the art appreciate that any arrangement which is calculated to achieve the same purpose may be substituted for the specific embodiments shown and that the invention has other applications in other environments. For example, the structure and method of the present invention may be used to provide access to any internal contacts or terminals within a printer cartridge or the like for testing or for other purposes and may be applicable to originally manufactured cartridges or the like. This application is intended to cover any adaptations or variations of the present invention. The following claims are in no way intended to limit the scope of the invention to the specific embodiments described herein.

What is claimed is:

1. A method of making a printer cartridge, comprising:

attaching a compressible, electrically conductive coil spring to a first conductive terminal on a first printer cartridge subassembly; and assembling the first printer cartridge subassembly in operative position with a second printer cartridge subassembly, wherein the compressible, electrically conductive coil spring electrically couples the first conductive terminal to a second conductive terminal on the second printer cartridge subassembly when the first and second printer cartridge subassemblies are assembled.

2. The method of claim 1, wherein attaching the compressible, electrically conductive extension comprises wedging at least an end coil of the electrically conductive coil spring between the first conductive terminal and a housing of the first printer cartridge subassembly.

3. The method of claim 1, wherein attaching the compressible, electrically conductive coil spring comprises attaching an end of the electrically conductive coil spring to the first conductive terminal by one of soldering or applying a conductive adhesive.

4. A method of making a printer cartridge, comprising:

attaching a compressible, electrically conductive extension to a first conductive terminal on a first cartridge subassembly; and assembling the first cartridge subassembly in operative position with a second cartridge subassembly, wherein the compressible, electrically conductive extension electrically couples the first conductive terminal to a second conductive terminal on the second cartridge subassembly when the first and second cartridge subassemblies are assembled, wherein attaching the compressible, electrically conductive extension comprises providing an electrically conductive coil spring to compensate for variations in thickness of a compressible toner seal or relative movement of the first cartridge subassembly relative to the second cartridge subassembly.

5. The method of claim 1, wherein the first cartridge subassembly is a developer roller subassembly of a laser printer cartridge and the second cartridge subassembly is a toner hopper subassembly.

6. The method of claim 5, further comprising coupling the first conductive terminal and the second conductive terminal to a capacitor type device to generate a signal responsive to a level of toner in the toner hopper subassembly.

7. The method of claim 1, further comprising forming an external electrically conductive access to the first conductive terminal, the first conductive terminal being inaccessible after assembling the printer cartridge.

8. The method of claim 7, wherein providing the external access comprises:

coupling a conductive strip to the first conductive terminal; and exposing a portion of the conductive strip externally to the printer cartridge when the first and second subassemblies are assembled.

9. The method of claim 8, wherein the first cartridge subassembly comprises a developer roller subassembly and wherein coupling the conductive strip to the first conductive terminal comprises attaching the conductive strip to a sensing bar of the developer roller subassembly, wherein the sensing bar is connected to the first conductive terminal.

10. A method of refurbishing a printer cartridge, comprising:

attaching an electrically conductive coil spring to a first conductive terminal on a first cartridge subassembly; and assembling the first cartridge subassembly in operative position with a second cartridge subassembly, wherein the electrically conductive coil spring compensates for variations in thickness of a compressible toner seal or relative movement of the first cartridge subassembly relative to the second cartridge subassembly to electrically couple the first conductive terminal to a second conductive terminal on the second cartridge when the first and second cartridge subassemblies are assembled and compress the toner seal.

11. The method of claim 10, wherein attaching the electrically conductive coil spring comprises wedging at least an end coil of the spring between the first conductive terminal and a housing of the first cartridge.

12. The method of claim 11, wherein the first conductive terminal comprises a bifurcated portion and wherein attaching the electrically conductive coil spring comprises extending a coil of the coil spring between bifurcations of the bifurcated portion.

13. The method of claim 10, wherein the first cartridge subassembly is a developer roller subassembly of a laser printer cartridge and the second cartridge subassembly is a toner hopper subassembly.

14. A printer cartridge, comprising:

a first cartridge subassembly;

a second cartridge subassembly attached to the first cartridge subassembly, wherein the first cartridge subassembly includes a first conductive terminal and the second cartridge subassembly includes a second conductive terminal that is normally in electrical contact with the first conductive terminal when the first and second subassemblies are attached to one another;

a compressible toner seal; and a compressible, electrically conductive extension attached to the first conductive terminal to compensate for variations in thickness of the compressible toner seal or movement of the first cartridge subassembly relative to the second cartridge subassembly when the first and second subassemblies are attached to one another to form the printer cartridge wherein the compressible, electrically conductive extension is a coil spring.

15. The printer cartridge of claim 14, wherein the coil spring is attached to the first conductive terminal by wedging at least an end coil of the coil spring between the first conductive terminal and a housing of the first cartridge subassembly.

16. The printer cartridge of claim 14, further comprising an external access to the first conductive terminal, the first conductive terminal being inaccessible when the first cartridge subassembly is attached to the second cartridge subassembly.

17. The printer cartridge of claim 14, further comprising a capacitor type device coupled to the first conductive terminal and the second conductive terminal to provide a signal responsive to a level of toner in the printer cartridge.

* * * * *